US006257244B1

(12) United States Patent
Williams

(10) Patent No.: US 6,257,244 B1
(45) Date of Patent: Jul. 10, 2001

(54) UNIFORMLY SIZE ADJUSTABLE HAIR-ENHANCING CAP AND METHODS OF MANUFACTURE AND OF CUSTOM FITTING

(76) Inventor: Raymond F. Williams, 1231 NW. 137th St., Boca Raton, FL (US) 33486

( * ) Notice: Subject to any disclaimer, the term of this patent is extended or adjusted under 35 U.S.C. 154(b) by 0 days.

(21) Appl. No.: 09/494,452

(22) Filed: Jan. 31, 2000

Related U.S. Application Data

(63) Continuation-in-part of application No. 09/114,325, filed on Jul. 13, 1998.

(51) Int. Cl.[7] ..... A41G 3/00; A41G 5/00

(52) U.S. Cl. ..... 132/54; 132/53; 132/55; 132/56

(58) Field of Search ..... 132/53, 54, 55, 132/56, 200, 201

(56) References Cited

U.S. PATENT DOCUMENTS

| | | |
|---|---|---|
| 1,545,881 | 7/1925 | Cohen . |
| 3,834,403 | 9/1974 | Ahn . |
| 3,884,248 | 5/1975 | Mendelson et al. . |
| 4,150,678 | 4/1979 | Photopulos . |
| 4,386,619 | 6/1983 | Williams . |
| 4,658,841 | 4/1987 | Won . |
| 5,562,111 | 10/1996 | Torres . |
| 5,647,384 | 7/1997 | Haber et al. . |
| 5,873,373 | 2/1999 | Narvick . |

FOREIGN PATENT DOCUMENTS 3542 123 A1 4/1987 (DE) .

*Primary Examiner*—John J. Wilson
*Assistant Examiner*—Robyn Kien Doam
(74) *Attorney, Agent, or Firm*—Oltman, Flynn & Kubler

(57) ABSTRACT

An adjustable hairpiece includes a hairpiece network with a flexible perimeter member having network ports, for fitting around the head of a wearer, the perimeter member having a forward segment and two side segments; two longitudinal guide lines each having network ports, the longitudinal guide lines having guide line forward ends secured to the forward segment and extending rearwardly, the longitudinal guide lines being laterally spaced apart from each other and defining a hairpiece top region and two hairpiece side regions; a flexible network draw line having a draw line middle segment located substantially between the longitudinal guide lines and dividing the network draw line into two draw line half segments, each half segment extending from the draw line middle segment across the top region forwardly and rearwardly in a spaced and repeating spiral crossing sequence while spiraling through ports alternately in the forward segment and in the given longitudinal guide line on the corresponding side of the hairpiece, and then each guide line half segment repeatedly crossing the corresponding side region in a spaced and repeating spiral crossing sequence through ports in the corresponding side segment and in the corresponding longitudinal guide line, the draw line half segments each terminating in a half segment free end; and a quantity of hair strands for securing to the hairpiece network; so that pulling the half segment free ends away from the network causes the draw line to contract the hairpiece against a wearer scalp.

10 Claims, 6 Drawing Sheets

UNIFORMLY SIZE ADJUSTABLE HAIR-ENHANCING CAP AND METHODS OF MANUFACTURE AND OF CUSTOM FITTING

FILING HISTORY

This application is a continuation-in-part of application Ser. No. 09/114,325 filed on Jul. 13, 1998.

BACKGROUND OF THE INVENTION

1. Field of the Invention

The present invention relates generally to the field of hair replacement devices such as hairpieces. More specifically the present invention relates to a hair intersperser which takes the form of a network of flexible lines and which includes draw line means for uniformly contracting or expanding the size of the hairpiece to custom fit an individual wearer head. The lines making up the network are crocheted with rows of hair strands for interspersing with wearer hair.

After the network is fitted to the wearer head, the network lines are tied so that the network permanently retains its fitted size. The network is died to approximate the hair color of the wearer, and rows of hair strands are secured to the network lines in quantities and locations corresponding to the specific needs of the individual wearer. A stock embodiment of the intersperser is optionally provided to which the hair strands are already attached and which draws against the wearer head during fitting to an approximated close fit for immediate use with minimized cost.

2. Description of the Prior Art

There have long been hairpieces for covering thin and bald areas of wearer heads with real or simulated hair strands. One hairpiece, disclosed in U.S. Pat. No. 4,386,619 issued on Jun. 7, 1983 to the present applicant, provides a network of lines to which hair strands are attached for fitting between and interspersing with existing wearer hair to supplement and add fullness to existing hair. A problem with these prior hairpieces has been that they do not always fit the wearer head closely and evenly, and most cover rather than enhance and supplement wearer hair so that a fully convincing and natural look is not always achieved.

Won, U.S. Pat. No. 4,658,841, issued on Apr. 21, 1987, teaches an assembled wig or wig kit. Won includes front and rear interconnecting strap networks for mounting a full head of hair strands. A problem with Won is that the wig is not size adjustable to conform to the dimensions of a particular wearer head. Another problem with Won is that it is not a hair intersperser to enhance actual wearer hair, but simply covers up wearer hair.

Other prior references fail to teach hair interspersal. Torres, U.S. Pat. No. 5,562,111, issued on Oct. 8, 1996, discloses a hair highlighting cap. Torres includes a means for isolating and separating hair segments for coloring, and does not teach hair strand interspersal. Narvick, U.S. Pat. No. 5,873,373, issued on Feb. 23, 1999 reveals an integrated wig having a wefting construction. Narvick is thus a wig rather than a hair strand intersperser. Haber, et al., U.S. Pat. No. 5,647,384, issued on Jul. 15, 1997, discloses hair pieces and mounting means for hair pieces. Photopulos, U.S. Pat. No. 4,150,678, issued on Apr. 24, 1979 teaches cushioned retainer pads for wigs. Mendelson, et al., U.S. Pat. No. 3,884,248, issued on May 20, 1975, discloses adjustable wigs with means for reducing the size of the wig caps. Size is reduced only along one circumferential path, and thus the Mendelson, et al. cap is not uniformly fitted onto the wearer head. Ahn, U.S. Pat. No. 3,834,403, issued on Sep. 10, 1974, reveals a wig construction in which spaced apart points of adjacent strips of wefting are joined together at points of attachment offset from strip to strip to form a wefting network which is expandable to conform to the wearer head. Ahn does not retain a fitted size for a particular wearer. Cohen, U.S. Pat. No. 1,545,881, issued on Jul. 14, 1925, teaches a foundation for shingle bob wigs. Bergmann & Co GMBH, German Patent Number DE 3542123 A1, teaches a net configured hair piece base of woven plastic material or perforated foil with a pull received attachment to natural hair of a wearer.

It is thus an object of the present invention to provide a hairpiece which intersperses hair strands with existing wearer hair for a fuller and more natural look.

It is another object of the present invention to provide a custom version of such a hairpiece which has size adjustment means to be drawn to very closely, uniformly and evenly fit the wearer head and which is dyed to approximately match the wearer hair color, and to which hair stands are subsequently added in quantities and locations as needed by the particular wearer.

It is finally an object of the present invention to provide such a hairpiece which is inexpensive to manufacture, sturdy and reliable.

SUMMARY OF THE INVENTION

The present invention accomplishes the above-stated objectives, as well as others, as may be determined by a fair reading and interpretation of the entire specification.

An adjustable hairpiece is provided, including a hairpiece network with a flexible perimeter member having a longitudinal array of network ports, for fitting around the head of a wearer, the perimeter member having a perimeter member forward segment and two perimeter member side segments; first and second longitudinal guide lines each having a longitudinal array of network ports, the first and second longitudinal guide lines having guide line forward ends secured to the perimeter member forward segment and extending rearwardly, the first and second longitudinal guide lines being laterally spaced apart from each other and defining a hairpiece top region and first and second hairpiece side regions; a flexible network draw line having a draw line middle segment located substantially between the first and second longitudinal guide lines and dividing the network draw line into two draw line half segments, each half segment extending from the draw line middle segment across the top region forwardly and rearwardly in a spaced and repeating spiral crossing sequence while spiraling through ports alternately in the perimeter member forward segment and in the given longitudinal guide line on the corresponding side of the hairpiece, and then each guide line half segment repeatedly crossing the corresponding side region in a spaced and repeating spiral crossing sequence through ports in the corresponding perimeter member side segment and in the corresponding longitudinal guide line, the draw line half segments each terminating in a half segment free end; and a quantity of hair strands for securing to the hairpiece network; so that pulling the half segment free ends away from the network causes the draw line to slide through the network ports and thereby to contract the hairpiece against a wearer scalp.

The longitudinal guide lines preferably each have a longitudinal guide line rear segment, and the draw line half segments, upon completing their spiral crossing sequence over the side regions, each wind in a spaced and repeating spiral crossing sequence from side to side in shoelace fashion between the longitudinal guide line rear segments. The draw line half segments preferably each cross the corresponding side region in a spiral including forward to rearward and rearward to forward crossing directions. The draw line half segments preferably each cross the corresponding side region in a spiral including upward to downward and downward to upward crossing directions.

The perimeter member forward segment preferably is formed of nylon braid; and the perimeter member side segments each preferably have a perimeter member side segment rearward end and each preferably is formed of plastic mesh having a longitudinal array of network ports. The perimeter member preferably additionally includes a perimeter member rearward segment formed of elastic material and having perimeter member rearward segment longitudinal ends with fasteners for removably fastening to the perimeter member side segment rearward ends.

The hairpiece of claim 1, additionally comprising a fixed network line having first and second fixed network line ends, the first fixed network line end being secured to a central point along one of the longitudinal guide lines, the fixed network line crossing from side to side over the top region in a spaced and repeating spiral crossing sequence and alternately passing through network ports in the first and second longitudinal guide lines, the second fixed network line end being secured to a forward point along one of the longitudinal guide lines.

A method of manufacturing an adjustable hairpiece network from the above recited elements, including the steps of: connecting each guide line forward end to a point along the perimeter member forward segment so that the first and second longitudinal guide lines extend rearwardly from the perimeter member forward segment and are laterally spaced apart from each other; placing the draw line middle segment between the first and second longitudinal guide lines substantially between the guide line forward ends and the guide line rearward ends; repeatedly extending each the half segment forwardly and rearwardly over the middle region and in a spaced and repeating spiral crossing sequence through corresponding network ports in the perimeter member forward segment and in the corresponding the longitudinal guide line; repeatedly crossing each half segment over the corresponding the side region in a spaced and repeating spiral crossing sequence through corresponding ports in the corresponding the perimeter member side segment and in the corresponding longitudinal guide line, so that the half segments each terminate in a half segment free end for gripping and pulling to contract the hairpiece around a wearer head; and securing hair strands to the network. The method preferably additionally includes the step of connecting each of the perimeter member forward segment ends to one of the perimeter member side segment forward ends.

A method of sizing the above-recited adjustable hairpiece for an individual wearer head, including the steps of: fitting the hairpiece network over and around the wearer head; pulling clusters of wearer hair through corresponding openings between the network line segments; pulling the draw line free ends away from the network to thereby contract the network into close and conforming proximity to the wearer scalp; tying the draw line free ends together so that the network maintains its particular contracted configuration; removing the hairpiece network from the wearer head; dying the hairpiece network to substantially match the color of the wearer hair; and securing a quantity of hair strands to the hairpiece network.

BRIEF DESCRIPTION OF THE DRAWINGS

Various other objects, advantages, and features of the invention will become apparent to those skilled in the art from the following discussion taken in conjunction with the following drawings, in which:

FIG. 3 shows the perimeter member and attached longitudinal guide lines;

FIG. 4 shows the structure of FIG. 3 with the fixed network line woven through the longitudinal guide lines and tied at the "X" marks;

FIG. 5 shows the draw line being positioned for weaving into the assembly, with the midpoint between the two longitudinal guide lines and toward the rear, dividing the draw line into draw line half segments;

FIG. 6 shows the draw line woven through the top region and the draw line ends ready for weaving across the side regions;

FIG. 7 shows one of the draw line half segments being woven across its corresponding side region forward to rearward;

FIG. 8 shows the other draw line half segment woven through the other side region forward to rearward.

DETAILED DESCRIPTION OF THE PREFERRED EMBODIMENTS

Figure 1:
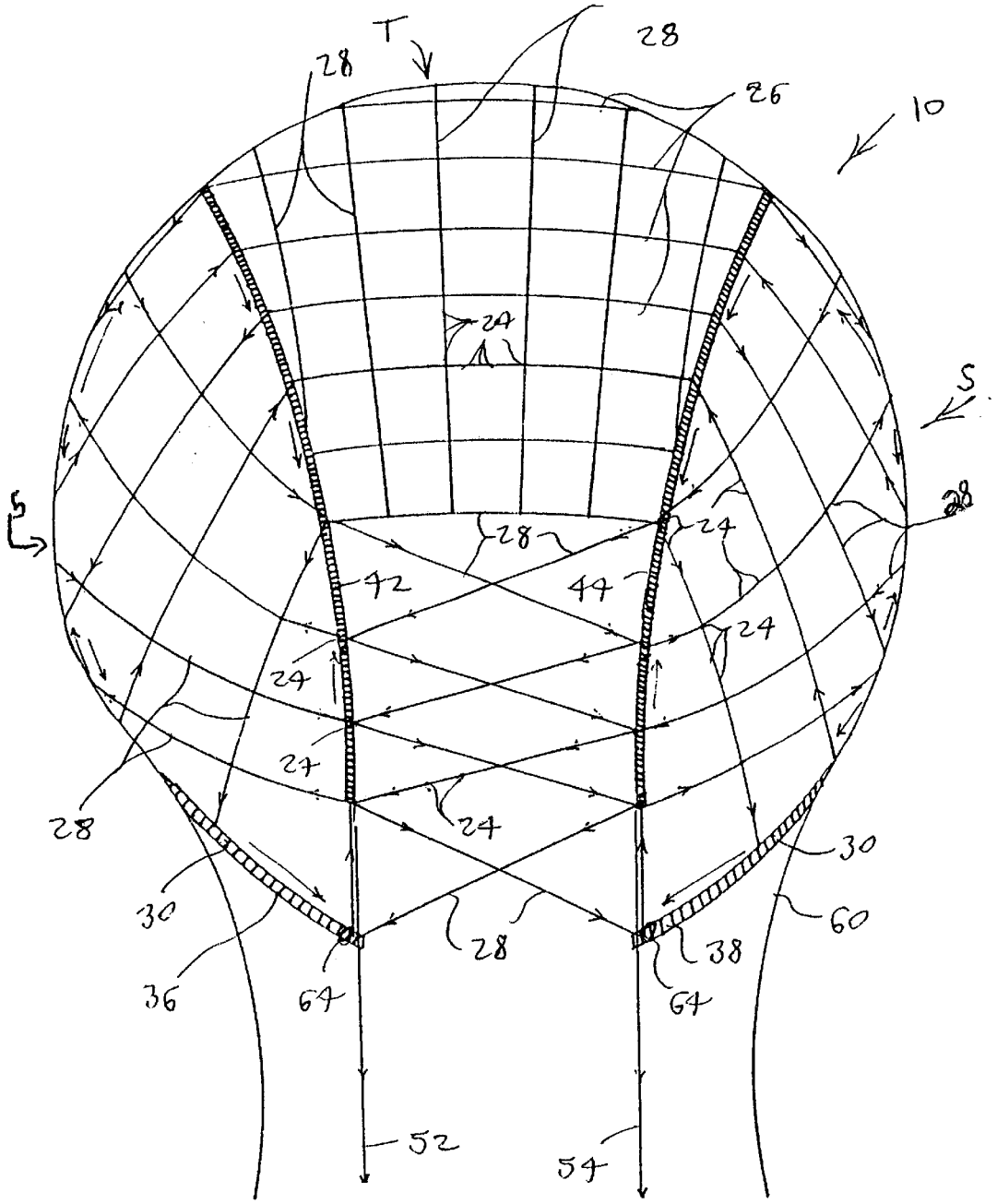
FIG. 1 is an upper, rear view of a form head fitted with the inventive intersperser, shown without the hair strands.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
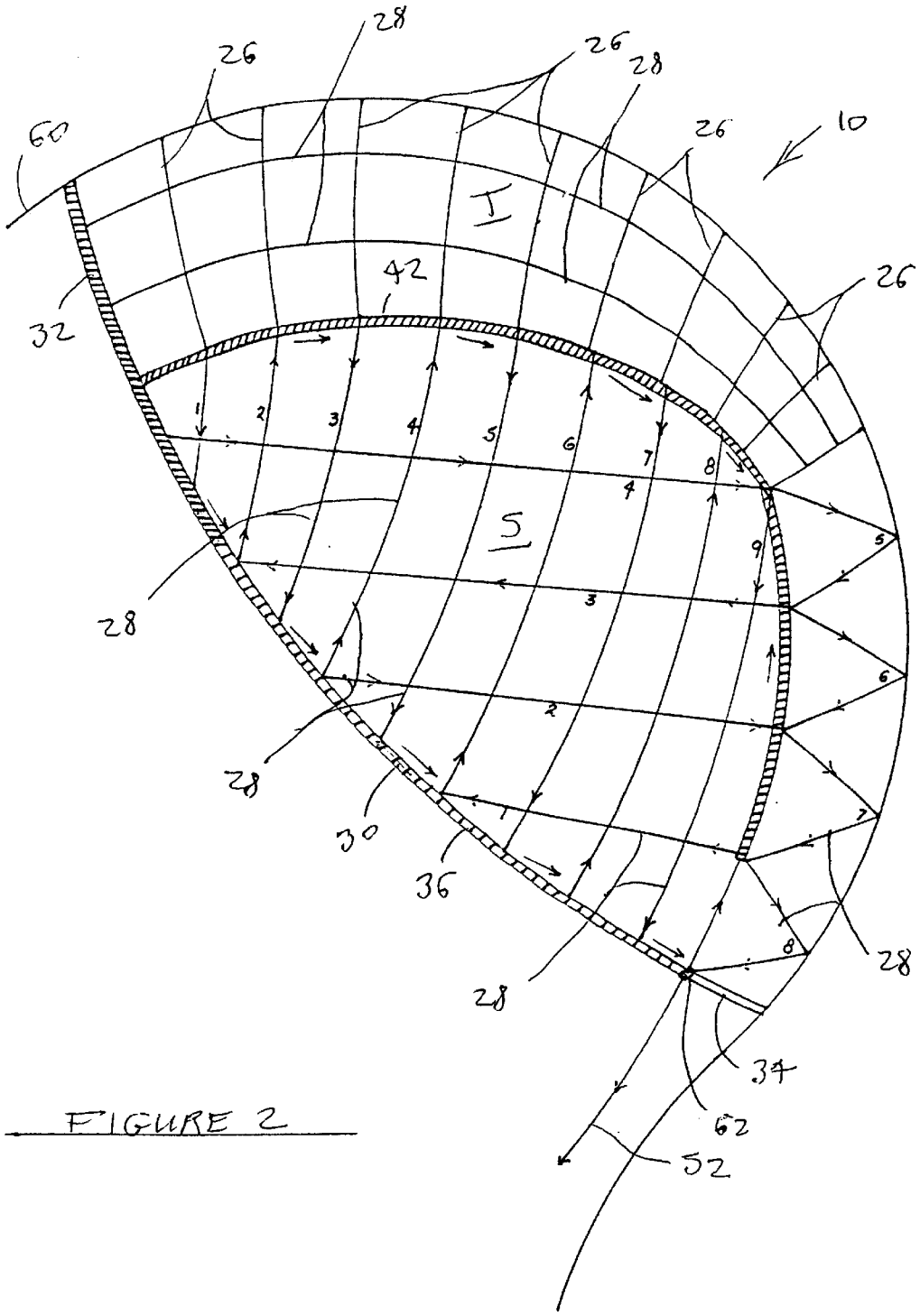
FIG. 2 is a side view of the form head and fitted intersperser of FIG. 1.
Figure 4:
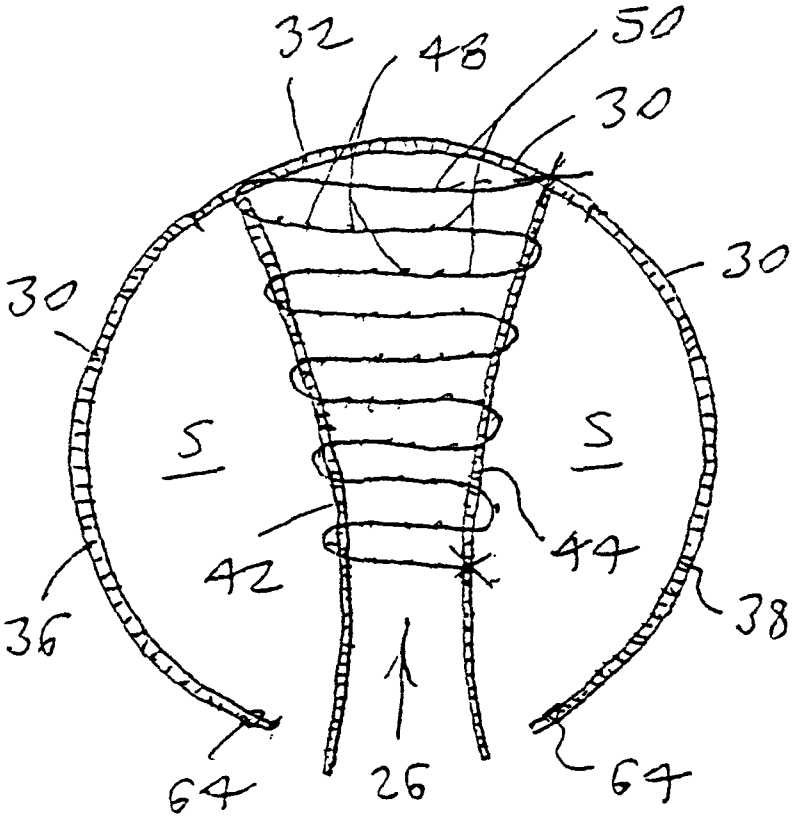
FIGS. 3–8 are a top views of the intersperser in progressive stages of assembly.
Figure 3:
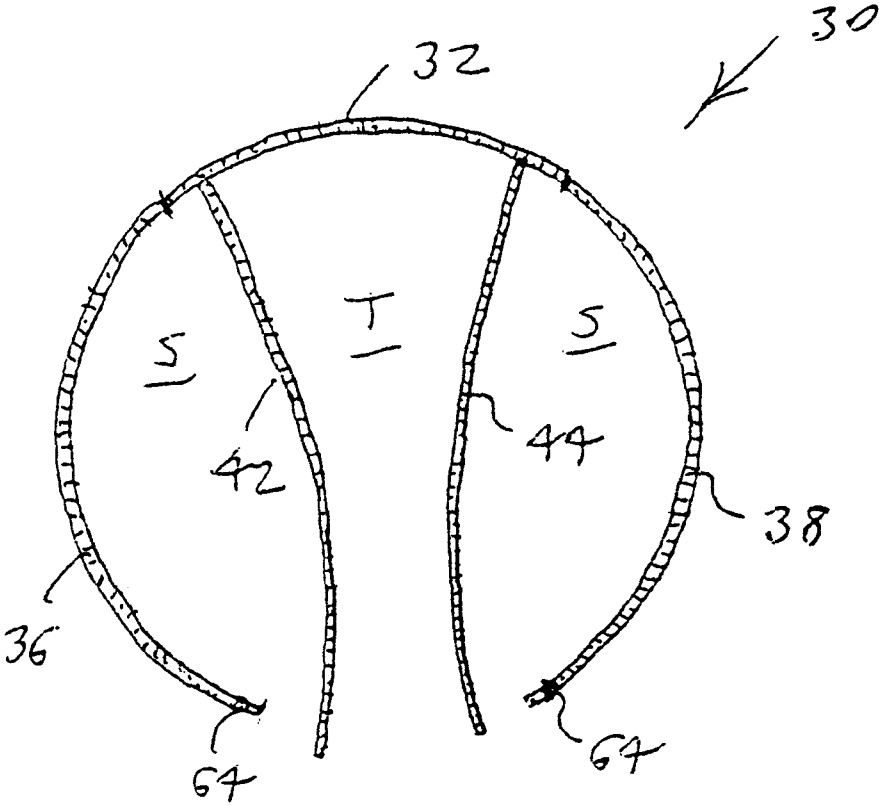
Figure 6:
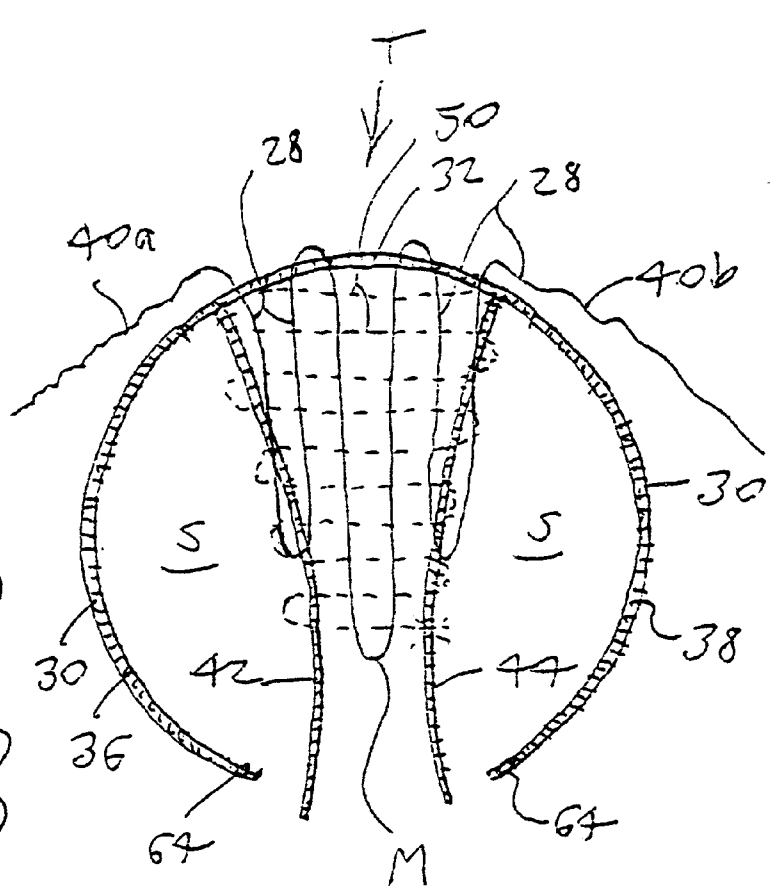
Figure 5:
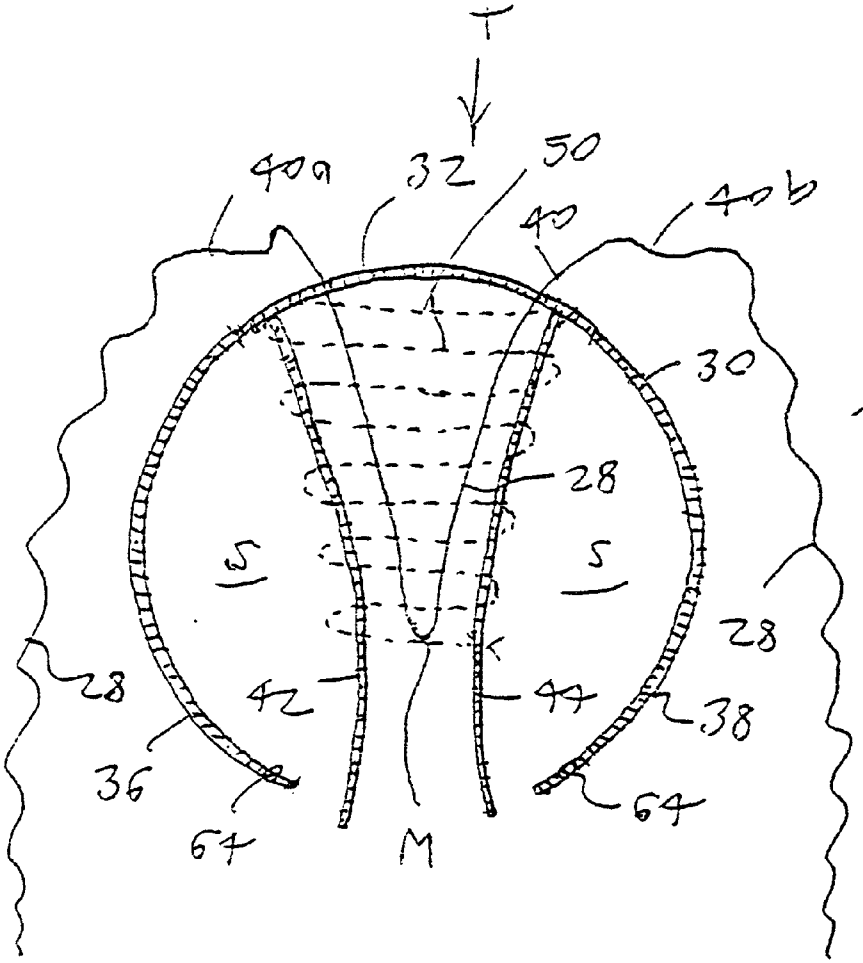
Figure 8:
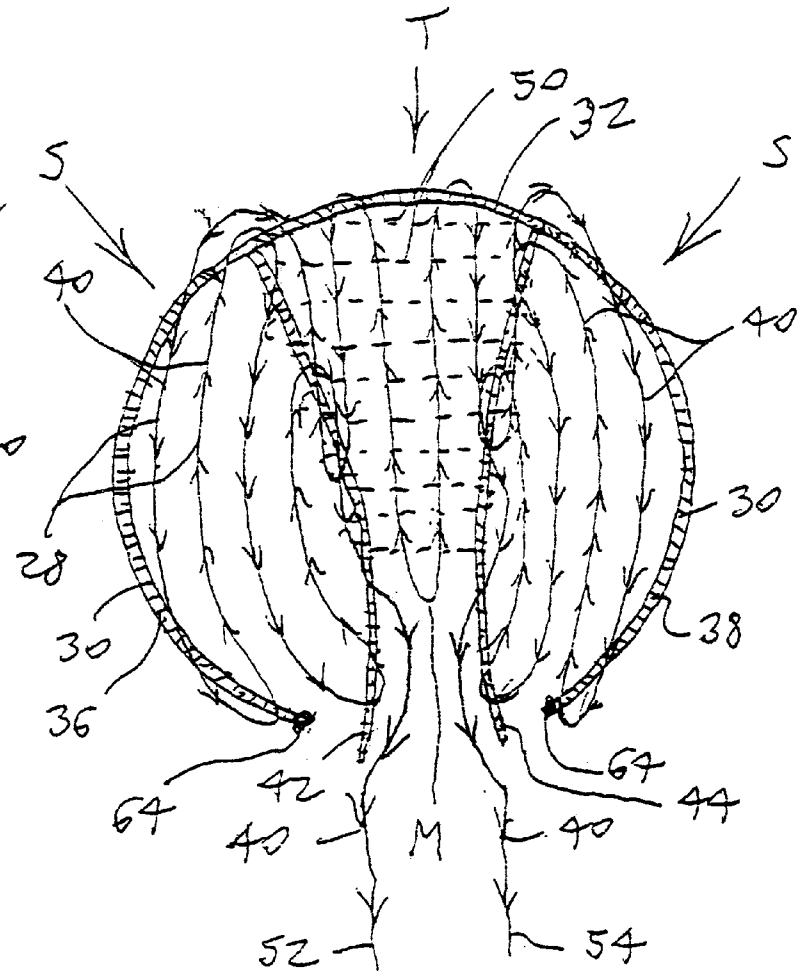
Figure 7:
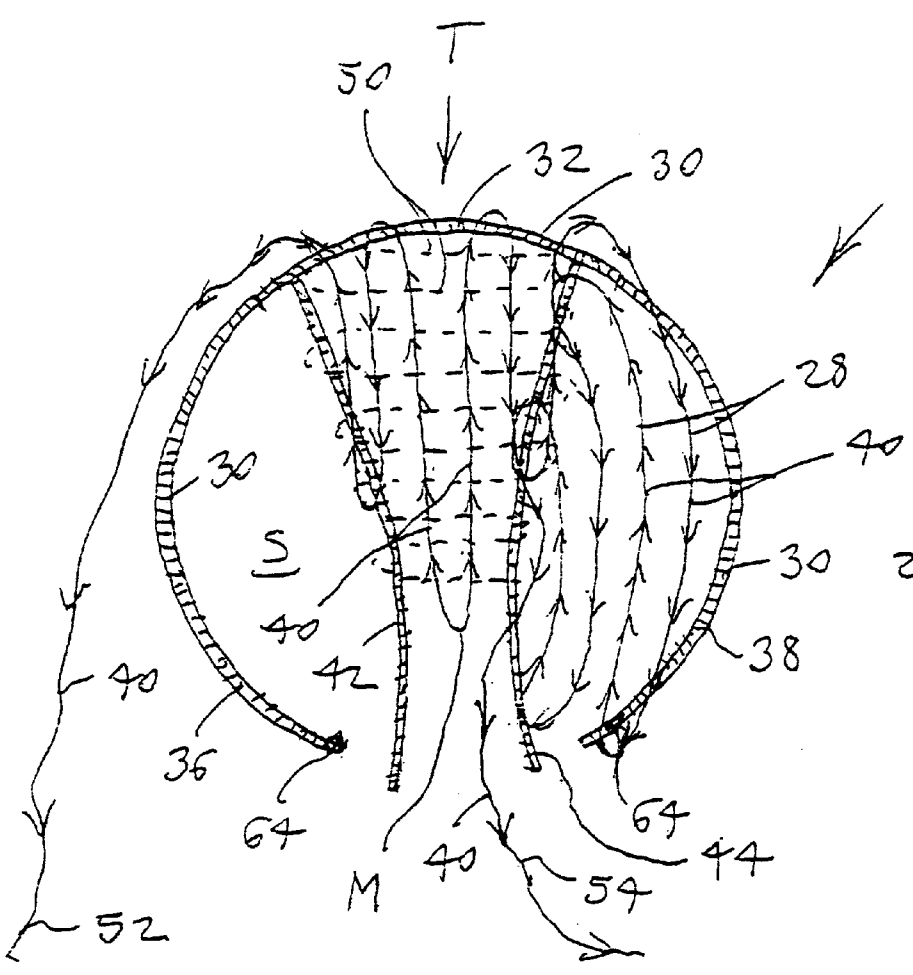
Figure 9:
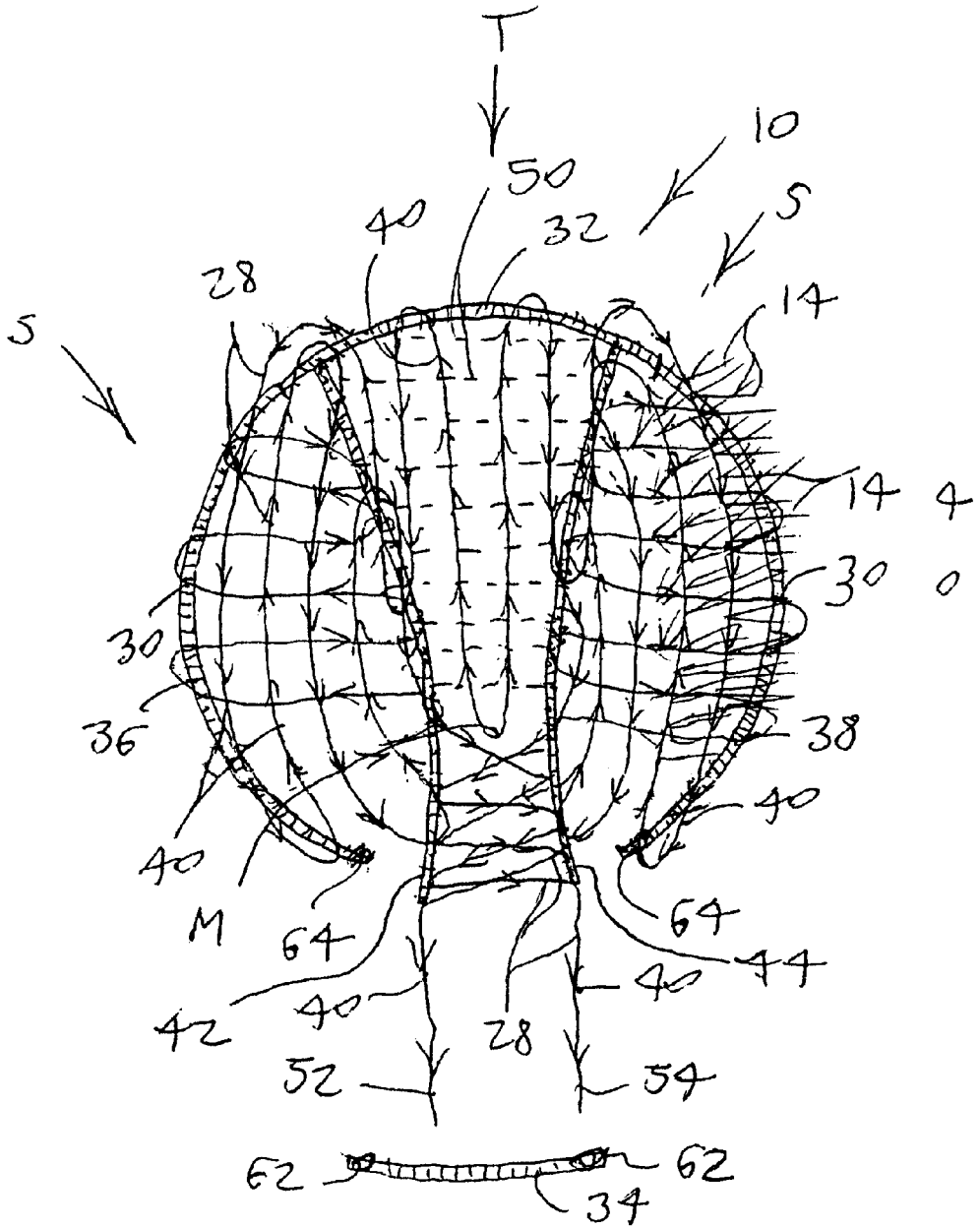
FIG. 9 shows the draw line half segments both woven back through their respective side regions upward to downward and shoe laced between the longitudinal guide lines at the rear, with the perimeter member rearward segment positioned for attachment with the snap fastener halves.

Referring generally to FIGS. 1–9, and specifically to FIGS. 1, 2 and 9, a hairpiece is disclosed which takes the form of an intersperser 10 having a network of lines crocheted with hair strands 14 for interspersing rows of hair strands 14 within thinning hair on a wearer head. All embodiments include draw line means for sizing intersperser 10 to custom fit an individual wearer head.

Intersperser Structure and Method of Assembly

A custom fit embodiment of intersperser 10 includes a flexible loop in the form of a composite perimeter member 30 for fitting around the wearer head. Perimeter member 30 preferably is constructed by connecting the lateral ends of a perimeter member forward segment 32 formed of elastic nylon braid having longitudinally spaced network ports 24 for crossing over the wearer forehead, with forward ends of left and right perimeter member side segments 36 and 38 formed of plastic mesh having longitudinal arrays of regularly spaced network ports 24, and subsequently connecting each rearward end of the left and right perimeter member side segments 36 and 38 with ends of a removable perimeter member rearward segment 34 formed of elastic material for crossing over the wearer upper neck area. See FIG. 3. Forward ends of first and second spaced apart longitudinal guide lines 42 and 44, respectively, are connected to perimeter member forward segment 32 and extend rearwardly over the top of the wearer head toward but stopping short of rearward segment 34 defining top region T and side regions S, respectively, of intersperser 10. Longitudinal guide lines 42 and 44 have network ports 24. A draw line 40 having first and second draw line end segments 52 and 54, respectively, spirals throughout and crosses between composite perimeter member 30 and guide lines 42 and 44 to form a composite network 20 which is uniformly contractible to draw the intersperser 10 snugly and evenly around the wearer head for a custom fit. Composite network 20 preferably includes a fixed network portion 26 and a draw line network portion 28.

The fixed network portion 26 is constructed first from a fixed network line 50 having a first end which is tied to the middle portion of second longitudinal guide line 44, extends laterally across top region T and passes through a network port 24 in first longitudinal guide line 42, advances forwardly along first longitudinal guide line 42 and then passes through another network port 24 in first longitudinal guide line 42, crosses back across the top region T and passes through a network port 24 in second longitudinal guide line 44, advances forwardly along second longitudinal guide line 44 and then passes through another network port 24 in second longitudinal guide line 44 and crosses back through top region T to first longitudinal guide line 42, and continues back and forth in this manner through and between first and second longitudinal guide lines 42 and 44 until it crosses adjacent to perimeter member forward segment 32, whereupon fixed network line 50 is tied to second longitudinal guide line 44 at this forward location. See FIG. 4. Fixed network line 50 is a chainline braid having a series of chainline openings 48, for passing the draw string line 40 and for receiving strands of hair tied such as by crocheting through fixed network line 50 after composite network 20 is completed. Depending on the extent of hair loss in the individual wearer, the spacing in the fixed network line 50 grid may be selected during manufacture to provide the appropriate density of lines of interspersed hair strands 14.

After fixed network line 50 is woven across top region T and is tied at both ends, draw line 40 is woven through intersperser 10. See FIGS. 5–9. The midpoint, or the middle segment generally, of draw line 40 is placed between first and second longitudinal guide lines 42 and 44 so that the two half segments 40*a* and 40*b* of draw line 40 extend laterally from the draw line midpoint M. Then each draw line half segment 40*a* and 40*b* is pivoted forwardly from draw line midpoint M to extend between the longitudinal guide lines 42 or 44 to perimeter member forward segment 32, fitted through a network port 24 in perimeter member forward segment 32, extended toward the corresponding side of intersperser 10 along perimeter member forward segment 32, fitted through another network port 24 in perimeter member forward segment 32 and then extended directly rearwardly to intersect the corresponding longitudinal guide line 42 or 44 where it passes through a network port 24. The given draw line half segment 40*a* or 40*b* is then advanced forwardly along the corresponding longitudinal guide line 42 or 44 and passes again through another network port 24 and is extended directly forwardly to intersect and pass through a network port 24 in perimeter member forward segment 32. The given half segment 40*a* or 40*b* is then advanced laterally outward along the perimeter member forward segment 32 and is fitted through another network port 24, from which it is extended directly rearwardly to the corresponding longitudinal guide line 42 or 44 where it is fitted through a network port 24. As the two half segments 40*a* and 40*b* cross forwardly and rearwardly between the perimeter member forward segment 32 and the corresponding longitudinal guide line 42 or 44, they pass through an opening 48 in each perpendicular segment of fixed network line 50 they cross.

The laterally advancing spiralling sequence of each half segment 40*a* and 40*b* continues until the half segments 40*a* and 40*b* are in close proximity to the intersection of the corresponding longitudinal guide line 42 or 44 and the perimeter member forward segment 32, at which point each half segment 40*a* or 40*b* is fitted through a network port 24 in forward segment 32 and is doubled back to pass rearwardly through the same network port 24 it passed forwardly through immediately before in the corresponding longitudinal guide line 42 or 44, and is then extended downwardly to the perimeter member side segments 36 or 38, and fitted through the perimeter member side segment 36 or 38 and then is extended rearwardly along the perimeter member side segment 36 or 38 and fitted through a network port 24 and then extended upwardly to and through a network port 24 in the corresponding longitudinal guide line 42 or 44, rearwardly along the corresponding longitudinal guide line 42 or 44 and then back to the perimeter member side segment 36 or 38 in a rearward spiralling sequence or weave across the corresponding side region S to the rearward portion of the corresponding longitudinal guide line 42 or 44 where it is fitted through a network port 24.

The given side segment 40*a* or 40*b* is then advanced forwardly along the longitudinal guide line 42 or 44 and is fitted through another network port 24 from which it extends forwardly across the side region S back to the perimeter member side segment 36 or 38 of composite perimeter member 30. Each side segment 40*a* and 40*b* is continued in this forward and rearward spiralling sequence or weave until each reaches close lateral proximity to the corresponding longitudinal guide line 42 or 44, at which point the side segment 40*a* or 40*b* is fitted through a network port 24 in the corresponding longitudinal guide line 42 or 44 and is extended across to the opposing longitudinal guide line 44 or 42 while advancing rearwardly. Then each given side segment 40*a* and 40*b* passes back across to the initial longitudinal guide line 42 or 44 while further advancing rearwardly and is fitted through a port 24, and both side segments 40*a* and 40*b* are made to continue this crossing, shoe-lace pattern until they reach the respective rearward ends of the longitudinal side segments 42 and 44, respectively, from which they simply hang and extend rearwardly to define draw line end segments 52 and 54. Hair or simulated hair strands 14 are secured to the lines making up the composite network during the below-described individualized fitting phase. For purposes of this application, and specifically for the claims, the term "hair strands" is understood to include real or simulated hair strands, or a mix of real and simulated hair strands.

Method of Fitting Intersperser to Individual Wearer Head

The intersperser 10 is fitted onto a wearer head so that the perimeter member forward segment 32 crosses the forehead, and side segment 36 and 38 free ends are pulled downwardly about the sides of the head so that draw line 40 pulls the draw line network portion evenly and snugly around the wearer head, with wearer hair pulled up evenly in clusters between the composite network 20 lines so that the composite network 20 rests virtually against the wearer scalp. Then the portions of the side segments 40*a* and 40*b* immediately adjacent to the rearwardmost port 24 through which they pass in the longitudinal guide lines 42 and 44 are marked, such as with a grease pencil. The intersperser 10 composite network 20 is then removed from the wearer head, dyed to substantially match the color of the wearer hair, and the draw line end segments 52 and 54 are tied to their corresponding longitudinal guide lines 42 or 44 and their remaining protruding free ends are cut away with scissors. The rearwardmost ends of the side segments 40*a* and 40*b* are provided with first snap fastener halves 62 during manufacture. The elastic perimeter member rearward segment 34 is provided at each end with a second snap fastener half 64, each of which is then snap fastened to the corresponding first snap fastener half 64.

Hair strands 14, whether real or artificial, are then fitted one by one through chainline openings 48 in the fixed network line 50 and through network ports 24 the draw string line 40 and tied, as shown in FIG. 8. The numbers of hair strands 14 fitted through each network port 24 or opening 48 depends on the thinness of the individual wearer hair, the thinner the wearer hair the more hair strands 14 are secured through each network port 24 and opening 48. When the desired number the hair strands 14 are all secured such as by crocheting, to the composite network 20, intersperser 10 is returned to the wearer for use. Intersperser 10 can be worn for extended time and the hair strands 14 washed together with the wearer hair. After a period of several weeks the intersperser 10 has to be removed while the wearer receives a hair cut or style, and intersperser 10 is then replaced on the wearer head.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An adjustable hairpiece, comprising:

a hairpiece network comprising a flexible perimeter member having a longitudinal array of network ports, for fitting around the head of a wearer, said perimeter member having a perimeter member forward segment and two perimeter member side segments; first and second longitudinal guide lines each having a longitudinal array of network ports, said first and second longitudinal guide lines having guide line forward ends secured to said perimeter member forward segment and extending rearwardly, said first and second longitudinal guide lines being laterally spaced apart from each other and defining a hairpiece top region and first and second hairpiece side regions; a flexible network draw line having a draw line middle segment located substantially between said first and second longitudinal guide lines and dividing said network draw line into two draw line half segments, each said half segment extending from said draw line middle segment across said top region forwardly and rearwardly in a spaced and repeating spiral crossing sequence while spiraling through ports alternately in said perimeter member forward segment and in the given said longitudinal guide line on the corresponding side of the hairpiece, and then each guide line half segment repeatedly crossing the corresponding said side region in a spaced and repeating spiral crossing sequence through ports in the corresponding said perimeter member side segment and in the corresponding said longitudinal guide line, said draw line half segments each terminating in a half segment free end;

and a plurality of hair strands for securing to said hairpiece network;

such that pulling said half segment free ends away from said network causes said draw line to slide through said network ports and thereby to contract said hairpiece against a wearer scalp.

2. The hairpiece of claim 1, wherein said longitudinal guide lines each have a longitudinal guide line rear segment, and wherein said draw line half segments, upon completing their spiral crossing sequence over said side regions, each wind in a spaced and repeating spiral crossing sequence from side to side in shoelace fashion between said longitudinal guide line rear segments.

3. The hairpiece of claim 1, wherein said draw line half segments each cross the corresponding said side region in a spiral comprising forward to rearward and rearward to forward crossing directions.

4. The hairpiece of claim 1, wherein said draw line half segments each cross the corresponding said side region in a spiral comprising upward to downward and downward to upward crossing directions.

5. The hairpiece of claim 1, wherein said perimeter member forward segment is formed of nylon braid; and wherein said perimeter member side segments each have a perimeter member side segment rearward end and each is formed of plastic mesh having a longitudinal array of network ports.

6. The hairpiece of claim 5, wherein said perimeter member additionally comprises a perimeter member rearward segment formed of elastic material and having perimeter member rearward segment longitudinal ends with fastener means for removably fastening to said perimeter member side segment rearward ends.

7. The hairpiece of claim 1, additionally comprising a fixed network line having first and second fixed network line ends, said first fixed network line end being secured to a central point along one of said longitudinal guide lines, said fixed network line crossing from side to side over said top region in a spaced and repeating spiral crossing sequence and alternately passing through network ports in said first and second longitudinal guide lines, said second fixed network line end being secured to a forward point along one of said longitudinal guide lines.

8. A method of manufacturing an adjustable hairpiece network from: a perimeter member forward segment having a longitudinal array of network ports and having perimeter member forward segment ends; two perimeter member side segments each having a longitudinal array of network ports and each having a perimeter member side segment forward end and a perimeter member side segment rearward end; first and second longitudinal guide lines each having a guide line forward end and a guide line rearward end; and a draw line having a draw line middle segment draw line half segments extending from said draw line middle segment and having a draw line end segment and hair strands, comprising the steps of:

connecting each said guide line forward end to a point along said perimeter member forward segment such that said first and second longitudinal guide lines extend rearwardly from said perimeter member forward segment and are laterally spaced apart from each other;

placing said draw line middle segment between said first and second longitudinal guide lines substantially between said guide line forward ends and said guide line rearward ends;

repeatedly extending each said half segment forwardly and rearwardly over said middle region and in a spaced and repeating spiral crossing sequence through corresponding network ports in said perimeter member forward segment and in the corresponding said longitudinal guide line;

repeatedly crossing each said half segment over the corresponding said side region in a spaced and repeating spiral crossing sequence through corresponding ports in the corresponding said perimeter member side segment and in the corresponding said longitudinal guide line, such that said half segments each terminate in a half segment free end for gripping and pulling to contract said hairpiece around a wearer head;

and securing hair strands to said network.

9. The method of claim 8, additionally comprising the step of connecting each said perimeter member forward segment end to one of said perimeter member side segment forward ends.

10. A method of sizing an adjustable hairpiece for an individual wearer head, the hairpiece comprising a hairpiece network comprising a flexible perimeter member having a longitudinal array of network ports, for fitting around the head of a wearer, said perimeter member having a perimeter member forward segment and two perimeter member side segments; first and second longitudinal guide lines each having a longitudinal array of network ports, said first and second longitudinal guide lines having guide line forward ends secured to said perimeter member forward segment and extending rearwardly, said first and second longitudinal guide lines being laterally spaced apart from each other and defining a hairpiece top region and first and second hairpiece side regions; a flexible network draw line having a draw line middle segment located substantially between said first and second longitudinal guide lines and dividing said network draw line into two draw line half segments, each said half segment extending from said draw line middle segment across said top region forwardly and rearwardly in a spaced and repeating spiral crossing sequence while spiraling through ports alternately in said perimeter member forward segment and in the given said longitudinal guide line on the corresponding side of the hairpiece, and then each guide line half segment repeatedly crossing the corresponding said side region in a spaced and repeating spiral spaced crossing sequence through ports in the corresponding said perimeter member side segment and in the corresponding said longitudinal guide line, said draw line half segments each terminating in a half segment free end; and a plurality of hair strands for securing to said hairpiece network; such that pulling said half segment free ends outwardly from said network causes said draw line to slide through said network ports and thereby to contract said hairpiece against a wearer scalp, comprising the steps of:

fitting said hairpiece network over and around the wearer head;

pulling clusters of wearer hair through corresponding openings between the network line segments;

pulling said draw line free ends away from said network to thereby contract said network into close and conforming proximity to the wearer scalp;

tying said draw line free ends together such that said network maintains its particular contracted configuration;

removing said hairpiece network from the wearer head;

dying said hairpiece network to substantially match the color of the wearer hair;

and securing a plurality of hair strands to said hairpiece network.

* * * * *